United States Patent [19]

Williams et al.

[11] 4,236,257

[45] Dec. 2, 1980

[54] WOMEN'S UNDERGARMENTS INCLUDING VENTILATED CROTCH ASSEMBLY

[75] Inventors: Harvey F. Williams, New Rochelle, N.Y.; Raymond C. Cole, Hillsdale; James G. Donaghy, Flanders, both of N.J.

[73] Assignee: International Platex, Inc., Stamford, Conn.

[21] Appl. No.: 895,216

[22] Filed: Apr. 10, 1978

[51] Int. Cl.[3] ..... A41B 9/04; A41B 9/00

[52] U.S. Cl. ..... 2/406; 2/78 C

[58] Field of Search ..... 2/406, DIG. 1, 409, 2/78 B, 78 C, 401

[56] References Cited

U.S. PATENT DOCUMENTS

| | | | |
|---|---|---|---|
| 2,190,425 | 2/1940 | Hurd | 2/78 B |
| 2,215,291 | 9/1940 | Hurd | 2/78 B |
| 3,322,120 | 5/1967 | Wyss et al. | 2/401 |

FOREIGN PATENT DOCUMENTS

| | | | |
|---|---|---|---|
| 1168224 | 10/1958 | France | 2/409 |
| 2303491 | 10/1976 | France | 2/409 |

*Primary Examiner*—Doris L. Troutman

*Attorney, Agent, or Firm*—Stewart J. Fried

[57] ABSTRACT

The present invention is directed to a female undergarment having a panty portion and includes a novel crotch covering portion of two superimposed faces. Both faces are of non-thermoplastic moisture absorbent fibers, and each face has a network of openings thereon in substantially uniform array. The face in proximity to the body has a lesser degree of openess than the outer face and is slightly spaced apart from the body of the wearer during body dynamics. The two faces preferably constitute two separate layers of material. Alternatively, they may be integrally knit together as by a double knit construction.

9 Claims, 17 Drawing Figures

FIG. 5
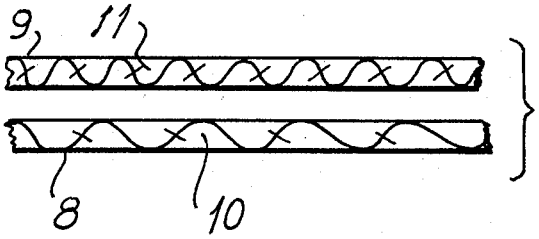
FIG. 6
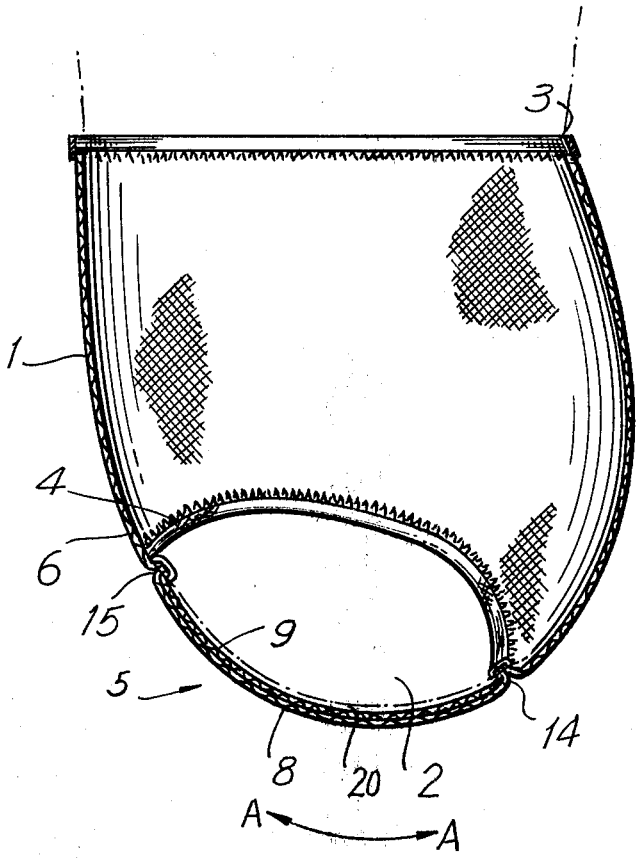
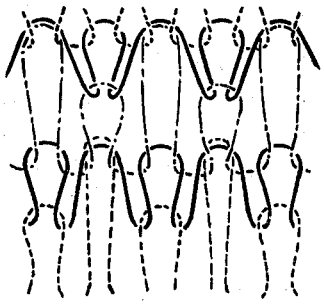
FIG. 7

WOMEN'S UNDERGARMENTS INCLUDING VENTILATED CROTCH ASSEMBLY

BACKGROUND OF INVENTION

1. Field of Invention

The present invention relates to women's undergarments, and particularly to women's undergarments including a ventilated crotch assembly.

2. Description of the Prior Art

There has been much written in the recent literature which suggests that for overall comfort and body benefit, the crotch assembly of women's undergarments should promote air circulation, be moisture absorbent, and permit the dissipation of body heat. This literature expresses the view that relatively non-porous nylon crotch linings in panties and pantyhose do not promote good hygiene and that feminine undergarments should have a soft, moisture absorbent crotch liner.

This view has created much interest, especially since many of the more popular types of women's panties are knitted of thermoplastic yarns such as nylon. The knit is relatively close, restricts air circulation and the nylon covers the crotch area of the wearer.

Many manufacturers have included cotton fabric in the crotch assembly. Oftentimes, this takes the form of an inner cotton linear against the outer shell or layer of thermoplastic yarn. Since the cotton liner is moisture absorbent, it will aid in drawing secretions away from the body and defuse them throughout the crotch area. While this may provide some improvement over an all nylon crotch assembly, the outer nylon shell is itself non-moisture absorbent and due to its relatively closed knit, still restricts air circulation.

Some manufacturers have sought to overcome this problem by eliminating the outer shell of nylon and providing only a single layer cotton crotch piece.

This approach, while eliminating the problemsome nylon outer layer, fails to recognize that a dual layer crotch construction is highly preferable in women's undergarments. Incontinence or vaginal discharge is not an unusual condition in women. By providing dual layers in the crotch construction there is an outer barrier liner which masks the possible staining or discoloration which may often occur during wear. Where there is only a single layer of material the masking advantages of the outer shell is lost. The panties become non-acceptable for use well before their useful life might otherwise expire. Yet, even with this disadvantage, where ventilation is sought, a single layer has been employed. This has recently taken the form of an openwork, mesh-like layer of material.

The mesh-like fabric has relatively large open areas of either a non-moisture absorbent thermoplastic yarn such as nylon or a moisture absorbent yarn such as cotton. While a greater degree of air circulation is potentially available due to the openwork nature of the material, the degree of masking against staining and/or discoloration is minimal. In addition, not only the undergarments but outer garments can be soiled as the relatively large open spaces permit body moisture to pass through the crotch layer. Even where the yarns employed have the potential for moisture absorption the relatively sparce surface area limits absorbency. There is also an aesthetic problem in that many women find such single layered open mesh arrangements undesirable for modesty reasons as there is a relatively high degree of body show-through.

While it might be supposed that the addition of a second barrier layer to the mesh-like material would overcome this deficiency, the addition of a thermoplastic layer is unsatisfactory. Moisture absorbency is not provided and air circulation is restricted. Surprisingly, the addition of a non-thermoplastic moisture absorbent outer layer, even one with a relatively high level of openness, may not in and of itself solve the problem. As hereinafter more fully set forth, where two non-thermoplastic layers of material are employed, even of a relatively openwork type, a heat retentive rather than a cooling effect can result.

While, at least one prior worker did appear to recognize that openings along may not be sufficient to provide ventilation and suggested a degree of flexibility to force air to the region, this has taken the form of a thin layer openwork elastic insert which covered but a part of the crotch and extended down the sides of the legs so that a bellows type effect would take place during wear. However, even in this teaching, the crotch still included major closed sections of close fitting fabric and but a thin ventilated channel was provided (See U.S. Pat. No. 1,106,310 to Kelly).

The present invention has solved these various problems. It provides a crotch assembly of two moisture absorbent, non-thermoplastic layers which overcomes the propensity for heat retention and which during wear provide an excellent level of air permeability; a high level of moisture absorbency; a high level of comfort; and an effective barrier arrangement for long wear life.

SUMMARY OF INVENTION

The present invention provides a female undergarment with a panty portion adapted to be in intimate contact with the female torso from at least proximate the waist to the thighs. It is understood that garments such as bikinis and hiphuggers which begin below the natural waist of the wearer are contemplated within such definition. The undergarment generally includes a front panel adapted to cover the pelvic zone; a rear panel adapted to cover the buttocks; and the crotch covering assembly. The crotch assembly has two faces. Both faces are of non-thermoplastic moisture absorbent fibers, and each face has a network of openings thereon in substantially uniform array. The outer face has greater openness than the inner face. The inner face is in proximity to, but is slightly spaced apart from the body of the wearer during body dynamics.

The crotch assembly is preferably constructed of two separate plies of material. Alternatively, the assembly can be integrally knit, such as by double knitting so that, albeit integral, the material has the attributes of a dual layered arrangement as it is of two thicknesses. In either form, the crotch assembly includes two dissimilar faces, each having a relatively high ratio of open areas to surface area.

The inner face (i.e. the one in direct proximity to the body cavity) is less open than the outermost surface, to provide the face in direct proximity to the body with a relatively greater fabric mass to accommodate the moisture slough-off. By providing a greater degress of openness in the outer face, the dissipation of the moisture as a result of air flow is enhanced.

When assembled, the faces are arranged to provide an air space between the body of the wearer and the inner face. The spatial setting apart during wear of sections of the inner face from the crotch enhances the proper functioning of the crotch assembly and permits the crotch assembly to more readily provide ventilation and enhanced coolness. It has been found that non-thermoplastic openwork fabrics, having apparently high air permeability characteristics and relatively low insulating properties, surprisingly, when placed in intimate contact with the body, permit only a small degree of heat dissipation. The present invention not only provides a novel combination of fabric constituents but emplaces them in an undergarment in a manner which enhances the potential for air permeability and heat dissipation in the wearing condition.

The manner in which the spatial setting apart of the crotch assembly to the panties (or other undergarments such as pantyhose) is accomplished may vary. It can be a function of the shape and/or manner of affixation of the assembly, or the stretch and/or non-stretch characteristics of the components, and/or the nature of other components of the undergarments. Various examples will be set forth and other variations will no doubt become apparent to those skilled in the art.

Spatial setting apart of a crotch piece vis-a-vis the body of a wearer especially during body movement while heretofore found in various undergarments, has generally been considered an undesirable characteristic. Especially in undergarments designed for women, a close fit between the crotch of the wearer and the garment has been considered aesthetically desirable, although often not fully accomplished. For example, the crotch portion in pantyhose, in part due to the downward pull exerted by the closed foot portion and the dropping down of the waistband when a downward pull is exerted, has a tendency to become spaced from the crotch of the wearer. It has heretofore been considered a desirable objective to design pantyhose to snugly fit the body and deter this type of action. This has been the case even where ventilation in the crotch zone is sought. Thus, for example, U.S. Pat. No. 3,815,156 to Gaither discloses the use in pantyhose of a crotch insert with large interstices with the crotch area knit of elastic yarns.

Even in undergarments for men where dual layers or dual thicknesses of material have been used to provide a fly front, the desire has been to provide a suspensory pouch which is close fitting so as to self-shape to the body of the wearer. This has been the case even where mesh-like crotch pieces were suggested. See e.g. U.S. Pat. No. 3,222,120 to Wyss and Testard.

Contrary to the foregoing, the present invention teaches the desirability in a feminine undergarment of dual layers or dual thicknesses of non-thermoplastic material which span the crotch area, and which include a pattern of openness and at least some spatial setting apart of the material from the body during wear. While the degree of spacing will vary during wear, preferably $\frac{1}{8}''$ to $\frac{1}{4}''$ is desirable.

Whether the crotch assembly is constructed of either a dual thickness knit material of two separate superimposed layers of material the face of the material in direct proximity to the body preferably provides a degree of open area to surface area of about 1–4, i.e. there is approximately 25% of open area when the material is measured in the relaxed state with a range of 20–30% being found particularly suitable. The outer face provides a degree of open areas to surface areas of about 1 to 2.64, i.e. 37.9% of open area when the material is measured in the relaxed state, although a degree of openness of from 30–40% in the outer face have been found to be particularly suitable. Preferably where there is a lesser percentage of open area in one layer, there should be a greater percentage in the other layer.

As employed herein, the term "openings" or "open areas" generally include the interstitial openings. With respect to the outer face, the term openings does not include the spaces inside the loops of the knitted construction itself. However, with regard to the inner face, since, as hereinafter described, a tuck stitch arrangement may be employed, a portion of the open area may, with respect to the inner surface, include a measurement of the openings inside the knitted loop. In both the inner and outer faces, the openings are regularly spaced apart and form a uniform pattern so that the entire extent of the assembly provides the positive air permeability, moisture absorptive and heat dissipation qualities.

The starting material(s) have a relatively low "Clo" value. Clo is a unit of measurement developed in 1941 by Drs. A. P. Gagge of Yale University; A. C. Burton of the University of Toronto and H. C. Bazett of the University of Pennsylvania. One Clo is approximately the value of insulation of one's everyday clothing that is, the amount of insulation necessary to maintain in comfort, a sitting-resting subject in a normally ventilated room (air movement 20 ft./minutes or 10 cm/sec.) at a temperature of 70° (21° centigrade) in a humidity of air which is less than 50%. A more detailed description of Clo can be found in the publication entitled "Science" 1941, volume 94, pages 428 et. seq. in an article entitled "Practical System of Units for the Distribution of Heating Exchange of Man with his Environment."

By providing an assembly having a relatively low Clo value, the potential for heat dissipation away from the body is present. If this potential can be realized in an assembled garment there will be a relatively high level of heat dissipation as the body will throw off rather than retain its heat. Since the present invention concerns an undergarment over which outerwear is normally worn, it has been found desirable that the Clo value be substantially below 1 Clo and is preferably in the range of 0.2 to 0.65 Clo.

The values set forth herein relative to the degree of openness to surface area for the inner and outer layers have been found to significantly affect the proper implementation of the present invention. Where the faces exceed the maximum level of open area the absorbency potential and the opacity levels are such as to provide levels of unacceptable performance. Where the faces have open areas of less than the minimum levels the Clo values have been as high as the 0.8 range. For example, where the outer layer had a degree of openness of 26.88% and the inner layer had a degree of openness of 18% the combined Clo value was 0.830. This should be compared with the Clo value of 0.546 of the preferred combination having a degree of openness of 37.8% in the outer layer and 25% in the inner layer. Thus, with an approximate difference of 29% in openness an approximate 65% difference in Clo value resulted.

While a wide variety of materials may be used in the practice of the present invention, where two separate layers of material are employed, the inner layer is preferably a 100% cotton knit construction using a tuck stitch configuration. For example, a two wale by four course repeat (as is known in the art), provides a series of interstitial spaces (hereinafter openings) through the thickness of the material. As the micro-photograph of FIG. 4*a* shows the construction may be such that in measuring the openness of the fabric some open areas incorporate the spaces between the loops. This particular construction is highly suitable in that it provides not only openness but in addition, a regular pattern and uniformity. These characteristics are conducive to both ventilation and uniform moisture dissipation. Further, the material provides the requisite strength and integrity to permit extended wear life characteristics not only for itself, but as a reinforcement liner for the more open outer layer. Preferably, the knitting is such that the ability to elongate in at least one direction is maintained. As assembled into the crotch construction, this ability to elongate or distend may be employed to promote the spatial relationship of the crotch assembly to the body, particularly as hereafter more fully described, if the elongation is employed in the front to back direction relative to the body or the wearer. As has been noted previously, however, the presence or absence of stretch in one or more directions is dependent upon other factors which the artisan may deem desirable.

The outer layer may be constructed in a number of ways. One example would be by knitting a circular knit eyelet fabric with particular stitches dropped at selected needles. One material which has provided particularly good results in a 100% cotton weft knit fabric using a 60/2 cotton count yarn of combed cotton. This particular construction has the advantage of uniformity, a high degree of openness and good wear life characteristics. The method of knitting such a fabric is disclosed in U.S. Pat. No. 4,015,444 to Johnson. In such a knit construction, there is relatively free stretch front to back (vis-a-vis the body of a wearer) with minimal to no stretch in the transverse direction. Again, the elongation characteristics may be employed in the affixation of the assembly to the panty or other undergarment to provide the required spatial relationship.

When the crotch construction is constructed of a double knit layer of material with two diverse surface characteristics, the "openings" presented at each face are in the ranges set forth above. Such double knitting techniques are known in the art.

Further, although not illustrated, various warp knit combinations may also be found suitable for use.

BRIEF DESCRIPTION OF THE DRAWINGS

The present invention may be better understood from the following detailed description and drawings of some preferred embodiments, in which:

FIG. 5 is a longitudinal section partially exploded of a dual layer crotch assembly with the inner and outer layers in superimposition;

FIG. 6 is a sectional view of FIG. 1 taken along lines 6—6 thereof;

FIG. 7 is a loop diagram of a fabric of FIG. 3*a;*

FIGS. 11*a*–12*a* are front elevational views of the crotch assemblies of FIGS. 11 and 12 respectively incorporated in undergarments.

Referring now to the drawings where like reference numeral indicate like parts in the various figures.

In FIGS. 1 and 2, the undergarment illustrated is a woman's panty 1. Other undergarments may be selected, such as pantyhose or girdles and the panty 1 is merely exemplary. Either from separate elements, or by integrally knitting, a basic covering from waist to thighs is provided with two leg openings 2. For comfort a waist elastic 3 and leg elastics 4 may be provided. The leg elastics 4 may also, as hereinafter described, more readily permit the elongation and return of the crotch assembly during body dynamics.

The crotch zone extends between leg openings 2 with the crotch assembly 5 preferably extending from the lower portion of the front 6 of the panty 1 to the lower portion of the rear 7 of the panty 1 so as to cover the entire perineal area (e.g. FIGS. 11–13). Other shapes are within the contemplation of the invention, however, it is preferable that at least the major portion of the perineal area be covered by the assembly.

The crotch assembly 5 provides two faces, outer face 8 and inner face 9.

Figure 1:
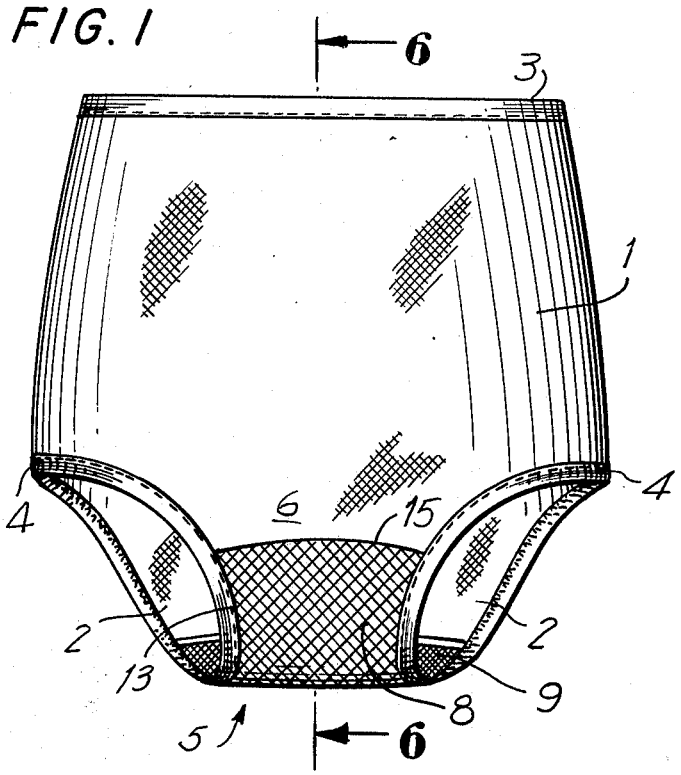
FIG. 1 is a front elevational view of an undergarment including the novel crotch construction of the present invention.
Figure 3:
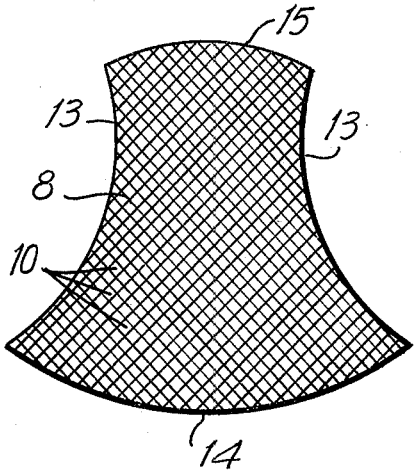
FIG. 3 is a top plan view of a preferred outer face configuration of the crotch assembly of the present invention which is incorporated within the undergarment of FIGS. 1 and 2.
Figure 2:
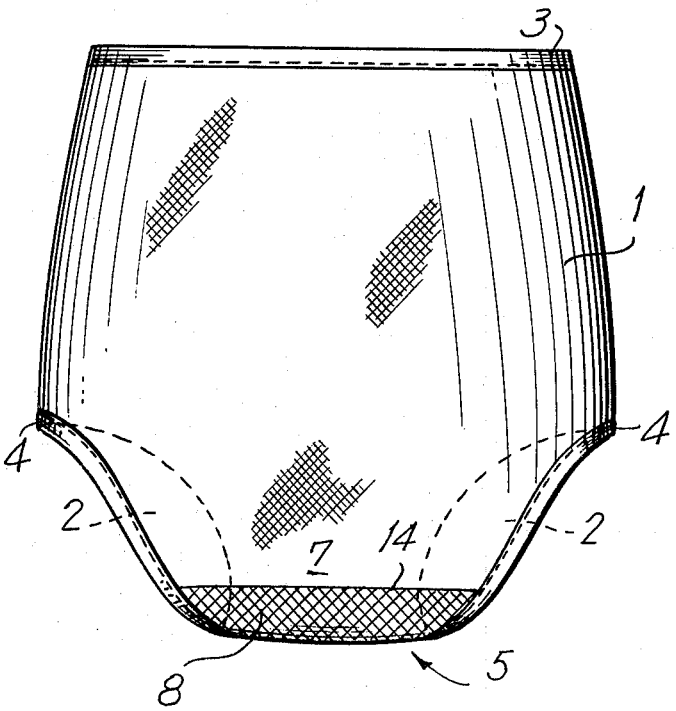
FIG. 2 is a rear elevational view of the same undergarment.
Figure 3A:
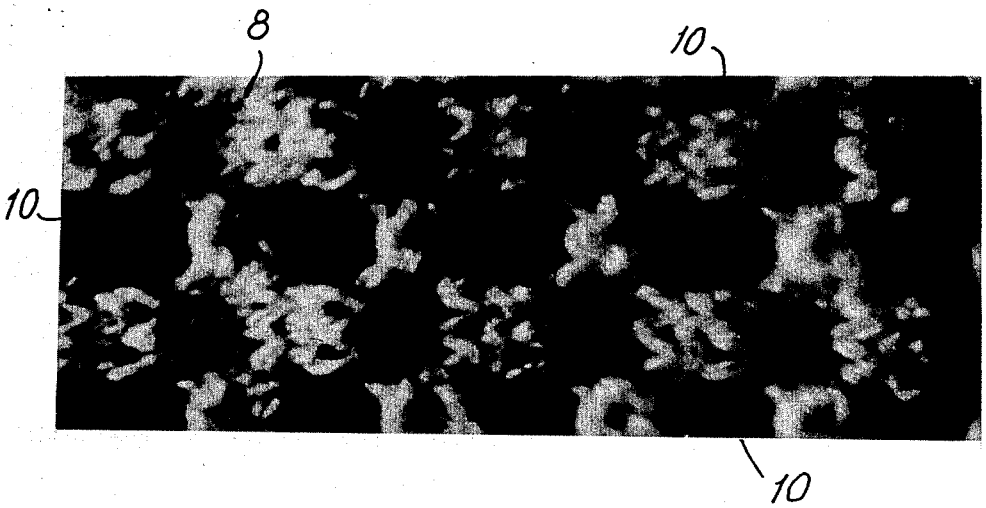
FIG. 3*a* is a microphotograph of a stitch construction (five times magnification) of a knit fabric such as will provide the face configuration of FIG. 3.
Figure 8:
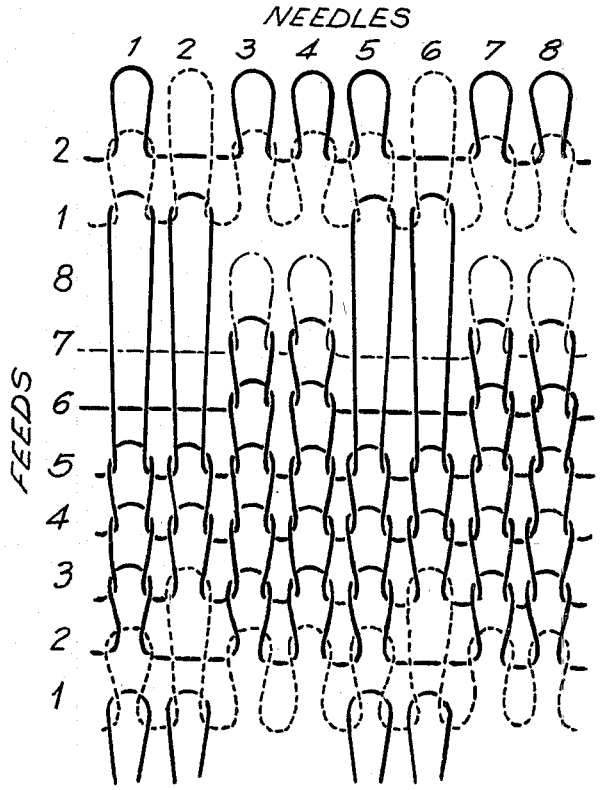
FIG. 8 is a loop diagram of the fabric of FIG. 4*a;*

Referring to FIGS. 3 and 3*a*, the outer face 8 includes a plurality of openings 10. The openings 10 provide a degree of openness of about 30–40% of the surface are arranged in a uniform pattern about the entire face. (It has been found that 37.9% openness as combined with the inner faces) provides particularly good results. This value has demonstrated good fabric integrity as well as the potential for a high level of air permeability and heat dissipation. An exemplary layer of such material may be knit from cotton yarn of 60/2 count with the knitting as shown in FIG. 8. Such a layer of material was tested in accordance with FTMS Method 5450 Thermal Testor employing standard laboratory procedures. It exhibited the following properties:

| | Air Permeability cmf ∩ 0.5" Water | | Thermal Properties |
|---|---|---|---|
| Clo | Range | Average | "U" BTU/hr/sq.f./°F. |
| 0.193 | 772–785 | 779 | 5,905 |

Figure 4:
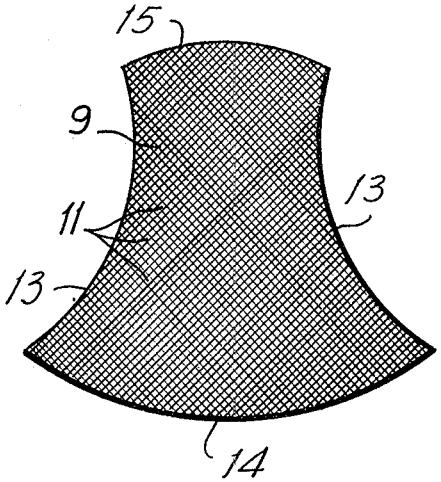
FIG. 4 is a top plan view of a preferred inner face configuration of the crotch assembly of the present invention which may be utilized in conjunction with outer face of FIGS. 3 and 3*a*.
Figure 4A:
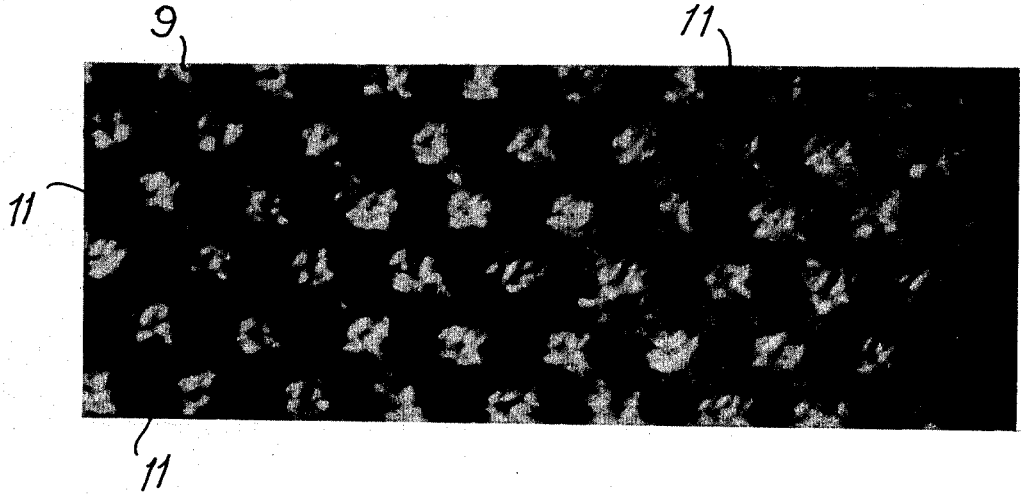
FIG. 4*a* is a microphotograph of a stitch construction (five times magnification) such as will provide the face configuration of FIG. 4.

Referring to FIGS. 4 and 4*a*, the inner face area 9 includes a plurality of open areas 11. The open areas 11 provide openings of approximately 25% of the surface area and are arranged in a uniform pattern about the entire face.

Figure 9:
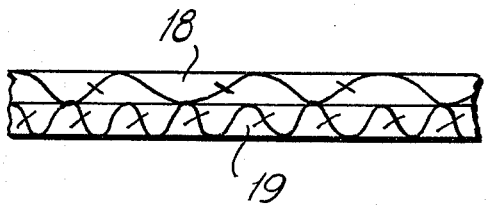
FIG. 9 is a longitudinal section of an alternative embodiment double knit construction in accordance with the present invention.

An exemplary layer 15 of material which when employed for the inner face 9 has been found to provide excellent results is a knit fabric made from cotton yarns of 60/2 count knitting according to the loop diagram of FIG. 9. This material was subjected to the same tests as the outer face material of FIG. 8. It exhibited the following properties:

| Clo | Air Permeability cmf ∩ 0.5" Water Range | Average | Thermal Properties "U" BTU/hr/sq.f./°F. |
|---|---|---|---|
| 0.451 | 681–766 | 721 | 2,519 |

The two materials were then superimposed and subjected to the same tests. The following results were found:

| Clo | Air Permeability cmf ∩ 0.5" Water Range | Average | Thermal Properties "U" BTU/hr.sq.ft./°F. |
|---|---|---|---|
| 0.546 | 452–474 | 463 | 2,083 |

However, this excellent potential for air permeability and heat dissipation is not realized in all situations. As the tests below illustrate, absent a spatial relationship between the material and the heat and moisture source (i.e. the wearer's crotch area) even an assembly with a significant degree of openness does not achieve its theoretical potential. Further, given a spatial relationship when compared with the more usual materials which make up the crotch constructions (hereafter "standard assembly") of panties (i.e. nylon outer face, cotton inner face), the present invention provides significantly greater coolness and moisture absorptive characteristics.

This latter combination (i.e. the standard assembly) may typically be made of a first layer of circular knit (jersey stitch) of a cotton (count 20/1) and a second layer of 40 denier nylon tricot.

Tests have been developed to simulate performance as it might be experienced in an undergarment. The test fabric representing the present invention is constructed as shown in FIGS. 3*a* and 4*a* in those tests where two separate layers are discussed.

The first test is referred to herein as the Aerated Chamber Test. The test is designed to measure relative coolness. Basically a medium (pulp and water) which has the capacity to register an increase or decrease in temperature is positioned relative to the crotch assembly material. A temperature close to normal body temperature is then simulated. A time interval is allowed to permit initial stabilization and then, through use of a flow of air, body movement is simulated.

The test procedure and the results thereof are set forth below. In the first procedure a spatial relationship between the medium and the crotch assemblies is present.

A. Aerated Chamber

A chamber was constructed by affixing a half inch thick plastic ring 3.6" in diameter to the surface of a warming tray set for a temperature range of 98°–101° F. A circle of compressed pulp fiber containing approximately 5.00 grams of water was preweighed and placed against the heated surface within the ring chamber. A thermocouple probe was placed ¼" from the pulp surface and the entire ring was covered with an embroidery hoop to which the test materials were mounted in a stretched state. A cardboard baffle containing a hole the size of the test chamber was placed in front of the entire set-up so that only the test material surface was exposed. A timer was started immediately and the temperature recorded at 5 minute intervals. After reaching a maximum temperature in the chamber, a fan 70" from the specimen was turned on at a low setting. When the temperature within the chamber had stabilized at its low point, the test was terminated. The test was repeated and the results are listed as follows:

Aerated Chamber

| Time Interval | Standard Assembly Temperarture °F. | Present Invention Assembly (2 layers) Temperature °F. | |
|---|---|---|---|
| 5 minutes | 94.00 | 93.85 | Stabilization time |
| 10 | 101.40 | 101.20 | |
| 15 | 103.2 | 102.50 | |
| 20 | 103.4 | 103.3 | |
| 25 | 103.4 | 104.0 | |
| | Cooling Fan Turned On | | |
| 30 | 95.75 | 90.25 | |
| 35 | 94.60 | 87.50 | |
| 40 | 94.00 | 87.00 | |
| 45 | 93.80 | 87.20 | |
| 50 | 92.80 | 87.00 | |
| 55 | 92.75 | 87.00 | |

Figure 10:
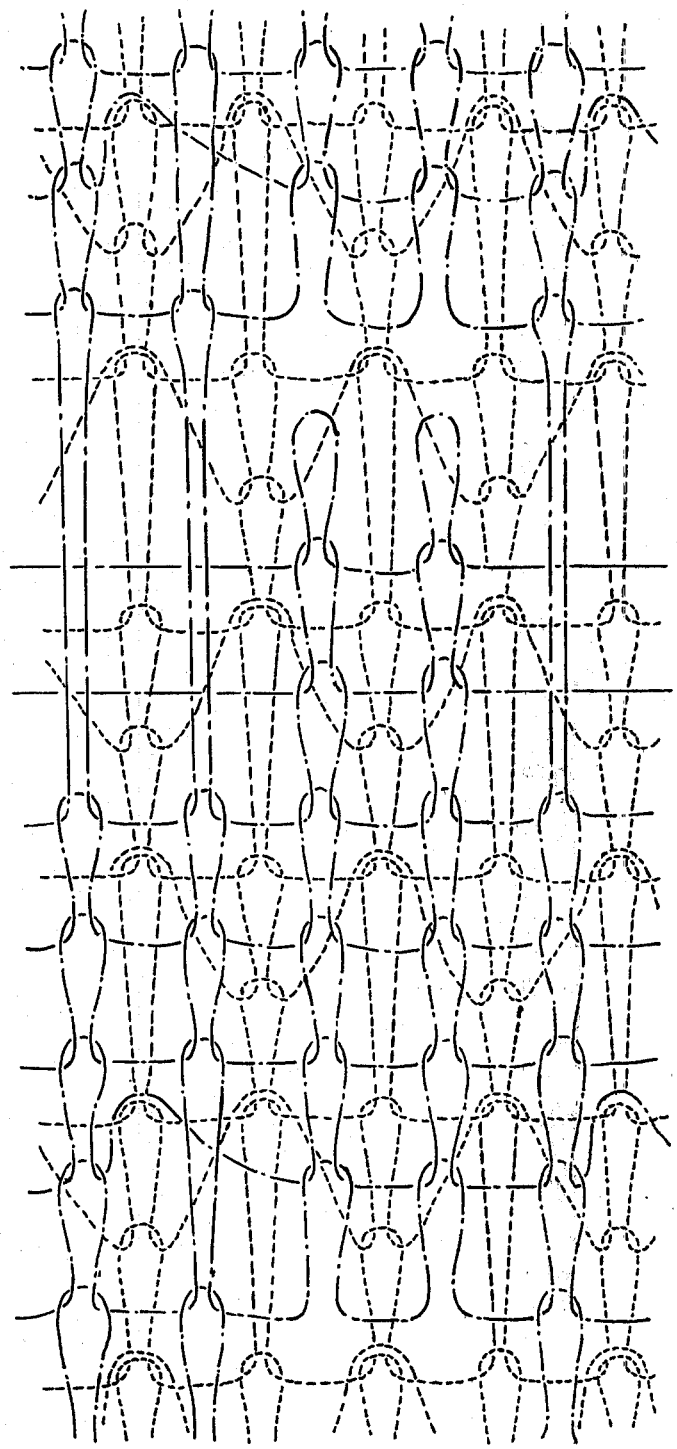
FIG. 10 is a composite loop diagram of the fabric of FIG. 9.

In addition, two samples of double knit material with openings on each face within the values hereinabove described were also subjected to comparative tests of another sample of "standard assembly" materials. The samples were generally constructed in accordance with that shown in FIG. 10 (the loop diagram of FIG. 10 being somewhat simplified for clarity).

Results:

| Time Interval | Present Invention Assembly Double Knit Example #1 Temperature °F. | Present Invention Assembly Double Knit Example #2 Temperature °F. | Standard Assembly |
|---|---|---|---|
| 5 minutes | 95.30 | 95.90 | 96.50 |
| 10 | 97.10 | 97.60 | 98.90 |
| 15 | 97.70 | 97.75 | 100.20 |
| 20 | 98.10 | 98.20 | 100.40 |
| 25 | 98.40 | 98.70 | 100.50 |
| | Cooling Fan Turned On | | |
| 30 | 93.40 | 92.75 | 96.00 |
| 35 | 92.10 | 91.30 | 94.70 |
| 40 | 91.70 | 90.75 | 94.75 |
| 45 | 91.75 | 90.75 | 94.30 |
| 50 | 91.75 | 91.50 | 94.00 |
| 55 | 91.25 | 91.60 | 94.00 |

Conclusion

The assembly of the present invention is not only cooler but cools down more rapidly than the standard assembly with the same spatial relationship.

Two additional tests were conducted using the separate layer embodiments of the present invention using like testing specimens which did not include a spatial setting apart of the crotch assemblies from the medium. In the first of these tests, two circles of pre-weighed wetted pulp were placed on the heat source. After a temperature probe had been emplaced in each, the standard crotch assembly was positioned directly on one specimen and the assembly of the present invention was positioned directly onto the other specimen. Note: This test differs slightly from the Aerated Chamber Test in that a plastic ring chamber is not employed.

The heat source was raised to 104° F. and the temperature recorded after 6 minutes. The following results were reported:

| Standard Assembly | | Present Invention Two Separate Layer Assembly | |
|---|---|---|---|
| Start | After 6 Minutes | Start | After 6 Minutes |
| 104° F. | 91.5° F. | 104° F. | 93° F. |

An air flow was induced over the surface as noted in the Aerated Chamber Test above and the following results were reported:

| Standard Assembly | | Present Invention Two Separate Layer Assembly | |
|---|---|---|---|
| Start | After 5 Minutes | Start | After 5 Minutes |
| 104° F. | 90.5° F. | 104° F. | 93° F. |

Absent the spatial relationship, the present invention substantially maintained its temperature and even with the network of openings, did not "cool down" the environment.

The test was repeated, using the full Aerated Chamber equipment and test procedure as described above, however, no spatial relationship was provided between the medium and the crotch assemblies. The following results were reported:

| | Standard Assembly | Present Invention Assembly |
|---|---|---|
| Time | Temperature | |
| 5 minutes | 94.10 | 95.50 |
| 10 minutes | 94.60 | 97.75 |
| 15 minutes | 95.00 | 97.40 |
| 20 minutes | 95.70 | 97.80 |
| 25 minutes | 96.75 | 98.25 |
| 30 minutes | 96.80 | 98.25 |

Even with the passage of air the assembly of the present invention was warmer. This was found even though the standard assembly does not have the degree of openness as the assembly of the present invention.

While the reasons for the difference in result with the air space can only be theorized, it appears as if, absent the particular thermal conductivity of a thermoplastic yarn such as nylon, and the use of only non-thermoplastic yarns such as cotton, the spatial relationship is significant.

The second type of test conducted was the Water Transmission Test.

The Water Vapor Transmission Test measures the moisture loss through different barriers and can be used to compare them.

The test is a standard ASTM test.

Water Vapor Transmission Test—Cup Method ASTM E96-53T

This procedure makes use of an aluminum cup with a 2.5" inside diameter, a clamping ring and gasket. Water is placed in the cup to a depth of ¼" and the test specimen is mounted over the mount of the cup and held in a stretched position by means of the clamping ring. The entire unit is weighed and then placed in a dessicator for an exact period of time after which is again weighed and the water vapor transmission calculated as follows:

$$\text{WVT in grams/sq. meter/24 hours} = \frac{C \times 24}{T \times A}$$

where

G = weight loss in grams

T = exposed time in hours

A = exposed area of test specimen in square meters (0.0032)

| Weight-cup/specimen/ water | Standard Assembly | | Present Invention Two Separate Layers | |
|---|---|---|---|---|
| | Trial 1 | Trial 2 | Trial 1 | Trial 2 |
| Original | 153.5772 | 151.9571 | 155.9017 | 154.2100 |
| After 24 hrs. | 151.9571 | 150.3480 | 154.2100 | 152.5623 |
| Weight loss (grams) | 1.6201 | 1.6091 | 1.6917 | 1.6477 |
| Water Vapor Transmission | 506.3 | 502.8 | 528.6 | 514.9 |

The same test was conducted using the double knit materials and the following results were reported:

| Weight-Cup/Specimen Water | Double Knit Present Invention Example #1 | Double Knit Present Invention Example #2 | Standard Assembly |
|---|---|---|---|
| Original (grams) | 153.1000 | 153.2831 | 159.2952 |
| Final (after 24 hours) | 151.7490 | 151.9283 | 157.9699 |
| Loss | 1.3510 | 1.3548 | 1.3253 |
| Water Vapor Transmission | 422.19 | 423.38 | 414.16 |

As is reported above, the moisture loss was greater with the assembly of present invention.

As illustrated in FIGS. 1–4, the spatial relationship between the inner face 9 of the crotch assembly 5 and the body may be provided by the shape of assembly 5 and the means by which it is incorporated into the panty 1. The crotch assembly 5 has a peripheral shape which includes oppositely aligned concave side edges 13 coextensive with a section of the leg openings 2 and a convex rear edge 14 and forward edge 15. This particular shape is not per se novel for a crotch construction and may be found in the art either in the form shown or in somewhat modified dimensional form.

The convex rear and forward edges 14 and 15 are of a sufficient length so that they transversely span the crotch cleavage and have segments which rest upon portions of the buttock and pelvic area. In its preferred form, the inner face 9 is a separate layer of material having elongation characteristics in a one-way direction. As assembled, such elongation is in the front to back direction vis-a-vis the body. In its preferred form, the outer face 8 is also a separate layer of material having a predominant ability to elongate in one direction. However, preferably, the layer also includes a lesser ability to elongate in the direction transverse to the direction of predominant elongation. As assembled, the predominant elongation is also in the front to back direction vis-a-vis the body of the wearer. This arrangement, as hereinafter discussed, can be employed to and in the maintaining of the desired spatial relationship.

The affixation of the side edges 13 of the crotch assembly along a portion of the leg openings 2 preferably is accomplished in a manner known in the art, e.g. via stretch stitch or by shirring, such that at least a portion of the ability of the crotch assembly 5 to elongate is preserved. The leg elastics 4 may advantageously be employed to provide a recovery force so that there is an ability for both elongation and recovery of the assembly.

When emplaced on the body by a wearer, the crotch assembly 5 will be initially subjected to tensional forces front to back and transversely between the thighs. While, for comfort, there will be a strain relief in the front to back direction, the transverse force will hold the crotch assembly taut, thus promoting a spatial setting apart of the inner face 9 and the body. While this may vary depending upon the anatomical differences between wearers, upon initial emplacement, it should be noted that this construction in such that at least a major portion of the crotch assembly is spatially separated from the body of a wearer. During body dynamics, for example, walking, this particular construction further promotes the provision and maintenance of a spatial relationship.

During walking, the side edge 13 of the crotch assembly 5 along the leg being extended is urged to elongate wherein the other edge along the non-striding leg is subjected to a lesser tension. As the following leg is brought forward to become the striding leg, the action is repeated. This action subjects the crotch assembly 5 to varying forces including a transverse tensioning between the legs. This creates some tautness transversely across the assembly which urges the crotch assembly 5 at least along a part of its extent to flatten out and thus become spatially set apart from the curvilinear shape of the body. Where, as in the preferred embodiment, the outer face 8 has some degree of available transverse stretch, the inner face 9 will have a tendency to be more taut than the outer face 8.

As illustrated in FIG. 3 a preferred pattern of openings 10 for the outer face is a uniform regularly spaced pattern preferably with openings along 37.9% of the surface area. A fabric having such a pattern is illustrated in FIG. 3*a* and further described in the loop diagram of FIG. 8.

As illustrated in FIG. 4, a preferred pattern of openings 11 for the inner face is a uniform regularly spaced pattern preferably with openings along 25% of the surface area. A fabric having such a pattern is illustrated in FIG. 4*a* and further described in the loop diagram of FIG. 8. The method of knitting therein illustrated is commonly known as a tuck stitch.

Where a double knit fabric is employed the opposed faces present the differing openwork patterns. Such a fabric can be constructed in accordance with FIG. 9 and the illustrative loop diagram of FIG. 10 wherein a double knit fabric 17 presents a first more open face 18 and a second less open face 19 along opposite surfaces.

As noted, however, the preferred form of the invention includes two separate layers of material for the crotch assembly 5, such as illustrated in FIGS. 5 and 6. The arrows A—A in FIG. 6 illustrate the preferred front to back elongation which might be employed to provide the spatial setting apart 20 of the layer 9 from the body (shown in dot-dash line) during body dynamics.

Figure 11:
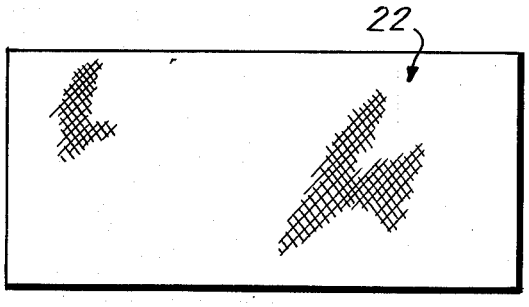
FIGS. 11–13 are plan views of other forms of crotch assembly configurations in accordance with the teachings of the present invention.
Figure 11A:
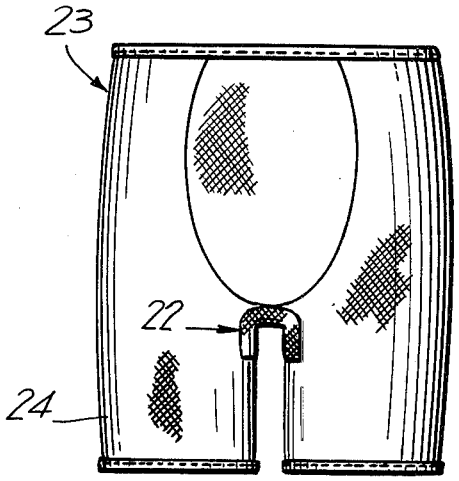
Figure 12:
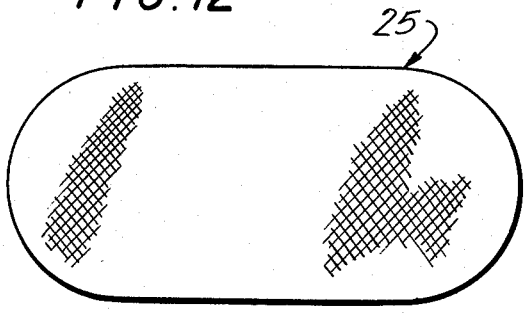
Figure 13:
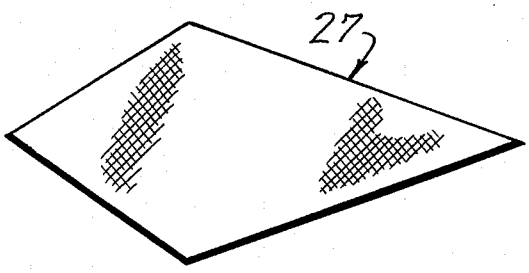

As illustrated in FIGS. 11–13 other configurations are contemplated. For example, there is illustrated in FIG. 11 a crotch assembly 22 having a substantially rectangular perimeter. Such a configuration might be employed in a panty girdle 23, such as illustrated in FIG. 11*a*. The legs encircling portions 24 of the panty girdle provide anchorage for maintaining the crotch assembly 22 in position vis-a-vis the body of the wearer. The crotch assembly extends not only over the perineal zone, but also extends along the inner thigh portion of the wearer. Thus the hold-down action of the leg anchoring portion 24 is directly transmitted to the crotch assembly 22.

Figure 12A:
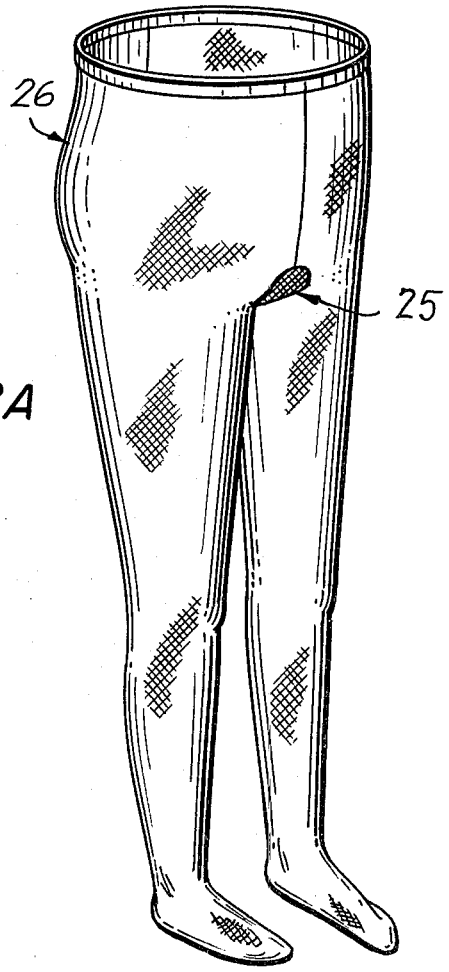

In FIG. 12 an elliptical crotch assembly 25 is illustrated. Such an assembly might be employed in an undergarment, such as stretch panty hose 26, as shown in FIG. 12*a* where the nature of the undergarment provides a relatively significant downward force through the crotch zone. This downward force is a function of the action of the stretch yarns in the leg sections providing a downward pull on the panty portion.

A diamond shaped crotch assembly 27 such as illustrated in FIG. 13 is also suitable for pantyhose constructions.

The shape of the assembly is not per se the significant feature of the present invention. Rather, it is the combination of the non-thermoplastic constituents of the assembly in terms of their moisture absorbent, air permeable, heat dissipation potential and the affixation to the undergarment in a manner which promotes the more advantageous use of these potential attributes.

Although particular embodiments of the invention have been illustrated and described, they are by way of example. It is contemplated that modification may be made within the scope of the claims without departing from the teachings of the invention.

What is claimed is:

1. A female undergarment, having a panty portion adapted to be in intimate contact with the female torso from at least the waist to the thighs, said panty portion including a front panel adapted to cover the pelvic zone of a wearer and a rear panel adapted to cover the buttocks of a wearer, upper thigh portions at least a portion of which define the leg openings of said undergarment, and a crotch covering portion, said crotch covering portion including a crotch assembly having a first surface ara and a second surface area, in superimposition one to the other, said first and second surface areas of non-thermoplastic, moisture absorbent fibers with each surface area having a plurality of openings therethrough defining an open network of substantially uniform array on each surface area, said first surface area openings network providing a system having a lesser degree of openness than the network of said second surface area and means to affix said crotch assembly to said upper thigh covering portion so as to position a major portion of said first surface area in direct proximity to and slightly spaced apart from the crotch area of the wearer, at least a major portion of said crotch assembly adapted to maintain a spatial relationship in response to body dynamics.

2. A frame undergarment as claimed in claim 1 wherein said first and second surface areas are separate layers of material.

3. A female undergarment as claimed in claim 1 wherein said first and second surface areas are of an integral unit of knit dual faced material.

4. A female undergarment as claimed in claim 1 wherein said undergarment is a panty.

5. A female undergarment as claimed in claim 1 wherein said undergarment is pantyhose and includes integral leg and foot covering parts.

6. A female undergarment as claimed in claim 1 wherein said crotch assembly has a peripheral shape including oppositely aligned concave side edges and convex front and rear edges, each side edge adapted to be affixed to an extent of its respective upper thigh covering portion and a respective edge of said convex front and rear edges affixed to said front and rear panel.

7. A female undergarment as claimed in claim 6 wherein said crotch assembly can elongate in the direction at right angles to said convex front and rear edges.

8. A female undergarment as claimed in claim 1 wherein 20 to 30% of said first surface area is open and 30 to 40% of said second surface area is open.

9. A female undergarment as claimed in claim 1 wherein said first surface area is a cotton fabric knit in tuck stitch of a two wale by four course repeat and said second surface area is a circular knit cotton eyelet fabric.

* * * * *